United States Patent [19]

Suey

[11] 4,070,151

[45] Jan. 24, 1978

[54] METALLURGICAL FURNACE WITH WATER-COOLED WORK SUPPORT

[76] Inventor: Paul V. Suey, 1043 Block Forest Road, Pittsburgh, Pa. 15235

[21] Appl. No.: 805,821

[22] Filed: June 13, 1977

Related U.S. Application Data

[63] Continuation of Ser. No. 633,214, Nov. 19, 1975, abandoned.

[51] Int. Cl.[2] ..... F23M 5/00; E04B 1/38; E04C 1/40

[52] U.S. Cl. ..... 432/234; 52/127; 52/511; 52/513

[58] Field of Search ..... 52/127, 511, 513, 506; 432/234

[56] References Cited

U.S. PATENT DOCUMENTS

| | | | |
|---|---|---|---|
| 1,419,395 | 6/1922 | MacKensie | 52/511 |
| 1,616,746 | 2/1927 | Gutridge | 52/513 |
| 2,693,352 | 11/1954 | Bloom | 432/234 |
| 3,169,754 | 2/1965 | O'Reilly | 52/725 X |
| 3,178,492 | 4/1965 | Ross | 52/513 X |
| 3,345,050 | 10/1967 | Guthrie | 432/234 |
| 3,486,533 | 12/1969 | Doherty et al. | 432/3 X |
| 3,647,194 | 3/1972 | Brungraber et al. | 432/234 |
| 3,687,093 | 8/1972 | Byrd, Jr. | 52/506 X |
| 3,747,291 | 7/1973 | Perigo et al. | 52/127 |
| 3,771,467 | 11/1973 | Sweet | 52/506 |

FOREIGN PATENT DOCUMENTS

| | | | |
|---|---|---|---|
| 1,342,891 | 1/1974 | United Kingdom | 432/234 |

*Primary Examiner*—Alfred C. Perham
*Attorney, Agent, or Firm*—Parmelee, Miller, Welsh & Kratz

[57] ABSTRACT

A metallurgical furnace for the high temperature heating of heavy metal objects for subsequent operation, such as rolling or forging, has a work support for the pieces being heated comprised of water-cooled tubes and supports enclosed with sectional heat insulating tile enclosing the tubes where the sections of tile are immovably secured to the tubes by fasteners each having a tubular shank extending from a flanged head portion embedded in the refractory radially inward to the inner surface of the tile where it is welded to the exterior of the water-cooled tube to prevent relative movement between the tile and the tube under the heavy impacts to which the support is subjected and to more effectively cool the refractory tile immediately adjacent the fasteners.

4 Claims, 6 Drawing Figures

METALLURGICAL FURNACE WITH WATER-COOLED WORK SUPPORT

This application is a continuation of my application Ser. No. 633,214 filed Nov. 19, 1975 and now abandoned.

Metallurgical furnaces in which metal slabs, billets and like heavy metal bodies are heated to a white heat for subsequent rolling, forging and like operations for conversion to finished or semifinished products are commonly provided with a work supporting frame generally having parallel longitudinally extending skid rails along which the work pieces to be heated are slid in a continuous succession so that when a fresh piece is pushed into the charging end, a heated piece is discharged at the exit end. These skid rails are in turn supported at intervals on cross-pieces with vertical supports. The frame is generally comprised entirely of metal tubes through which cooling water is circulated and the tubes are encased in heat insulation to protect them from direct exposure to furnace heat and reduce the transfer of heat in the furnace to the cooling water. Preformed tiles of some refractory composition are commonly used as insulation. Since the supporting frames are subjected to severe shocks and impacts from the workpieces being loaded into the furnace and the subsequent shoving and sliding of the workpieces therethrough, it is important that the insulating tiles be tightly fitted and attached to the tubes, since even a little looseness allowing relative movement between the tubes and the insulation accelerates the breakage, spalling and disintegration of the tiles.

Briefly, the present invention provides improved means for securing insulating tiles to the tubular frame in a furnace under these conditions in such manner as to securely integrate the tiles and tubing. The tiles are formed in two complementary sections separated longitudinally, which is common practice in the art. Each tile section is provided with at least two fasteners for securing it to the tubular frame. Each such fastener comprises a stud having a tubular shank with a laterally enlarged head portion embedded in the refractory inwardly from the outermost surface of the tile. The hollow shank has an inner end extending through the refractory, or a slight distance short of being entirely through, the arrangement being such that a welding rod may be inserted from the exterior of the tile and through the shank to contact the metal pipe and weld the inner end of the fastener to the tube. If the hollow shank is slightly short of contacting the pipe, the molten metal will enter the crevice between the pipe and the shank and, upon cooling, create a slight tension.

The invention may be more fully understood by reference to the accompanying drawings, in which:

FIG. 1 is a vertical section through one of the studs apart from the tube and tile;

FIG. 2 is a transverse section, on a smaller scale than FIG. 1, showing a water-cooled tube with a skid rail at the top and with two complementary tiles applied thereto and held in place by studs such as shown in FIG. 1, the view being a staggered section in the plane of line II—II of FIG. 3, different stages of the process being illustrated, with the two left studs being complete and the holes filled with refractory cement, while the lower right stud has been welded but not filled with cement and the upper right stud has yet to be welded;

Figure 1:
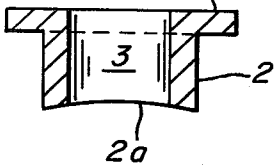

Referring first to FIG. 1 which shows the stud apart from the tile, the stud has a shank portion 2 which has an axial opening 3 and at the other end of the shank there is an annular flange 4 comprising a head portion of larger diameter than the shank. As here shown, the shank is cylindrical and the head is a circular disk, but the parts may be otherwise shaped to accomplish the purpose of this invention.

Figure 2:
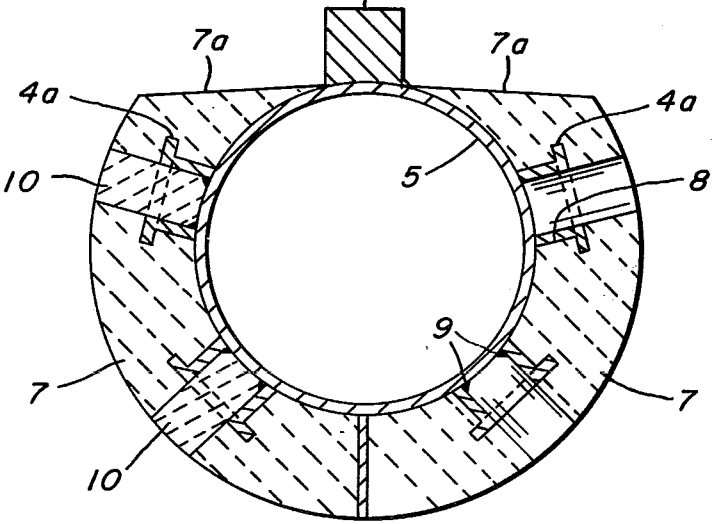

In FIG. 2, a tube 5 is shown with a skid rail 6 along the top. The insulation comprises two complementary tiles 7 which are shaped to fit around the tube, leaving only the rail portion 6 exposed. Where the insulation is provided around a water-cooled tube not having a rail, such as perhaps a vertical tube comprising a support for the rail, each of the two tile sections would be completely semicircular instead of having their top edge portions cut away or flattened to expose the rail 6. Insulating blocks or tiles of this form are not, in themselves, new.

According to the preferred embodiment of this invention, the tiles are formed with the studs embedded therein. When this is done, the inner end of the shank of each stud is flush with the inner surface of the tile, and this end is desirably hollow ground, as indicated at **2*a*, so that its end conforms to the curvature of the tube against which it bears. This requires that the studs be properly positioned in the refractory during the making of the tile. As shown, each tile, which in practice is commonly about 12 inches long and curved to conform to the surface of the tube against which it is placed, has at least two of these studs embedded therein near each of its ends, the two studs in each end portion and being angularly and axially spaced from each other. The studs in the skid rails, moreover, are set so that radial axis of each of the uppermost studs makes a smaller angle with the plane of the horizontal diameter of the tube about which the tiles fit than the lower ones. This is so that there will be adequate thickness of insulation between the edge portions 4*a* of the flanges of the studs and the flattened surfaces 7*a*** of the tile. Where the tiles are fully semicircular to fit around a tube which does not have a rail, the two studs in each end portion can be positioned at the same angle to the surface and the axis of the tube.

Before the refractory has become hard, a hole 8 is made in the tile in axial alignment with the center axis of the stud, and while its diameter is not critical, it need only be about equal to the inside diameter of the passage 3 provided by the tubular shank.

With the tile held tightly against the tube about which it is to be secured, an arc welding electrode is worked around the inner end of the tubular shank with the tube being an opposite electrode, forming a weld 9 joining the inner end of the stud to the surface of the tube, and as the weld cools, it tends to pull the stud tight against the tube. After this has been done, refractory mortar or cement 10 is forced into the hole 8 and into the stud to protect the stud, particularly its outer end, from direct exposure to the furnace gases and heat.

The stud is a rigid metal structure thick enough to be welded to the tube in the manner above described and is desirably located deep enough from the outer surface of the tile and near enought to the water-cooled tube that it will not heat soften under normal conditions of use. Thus, it tightly holds the tile against the tube at all times so that there is no relative movement or at least no appreciable relative movement between the tube, the stud and the refractory when the tube or its rail receives shock or impact such as those encountered in furnace structures.

Figure 4:
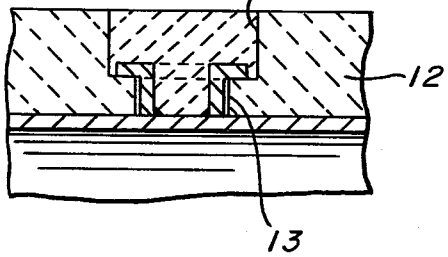
FIG. 4 is a fragmentary view of a modification wherein the tile is provided with a countersunk hole for the reception of the stud after the tile has been made.

In the modification shown in FIG. 4, the stud is the same as previously described having a tube-like or hollow shank and a head portion in the form of a flange extending laterally from the upper end of the shank. Instead of the stud being molded into the tile as it is being formed, the tile 12 is either molded with or subsequently has formed therein holes 13 with their outer ends countersunk at 14, each of the holes being designed to snugly receive the shank of the stud and the countersunk recess is designed to snugly receive the head portion of the stud. As in the form first described, the well or countersink is deep enough so that the head of the stud is set far enough in from the outer surface that, after the studs have been welded in place against the tube and the hole and the cavity filled with refractory insulation, the heads are well protected against exposure to the furnace atmosphere or excessively high temperature. Preferably this is close enough to the water-cooled tube and far enough from the outer surface of the tile that the temperature is under 1000° F., perhaps about 800° F., during normal furnace operation, as is also the case with the form shown in FIG. 2.

Figure 5:
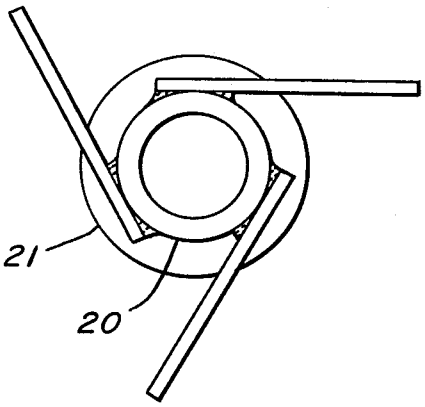
FIG. 5 is a plan view of a modified stud.
Figure 3:
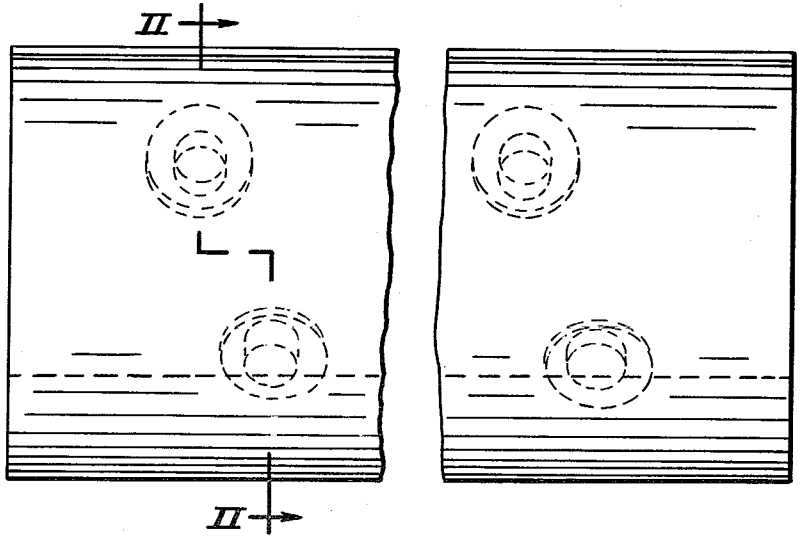
FIG. 3 is a side elevation of a section of tile, foreshortened to indicate the use of studs near opposite ends of a tile, the view indicating that the holes have been filled with refractory cement.

In the modification shown in FIG. 5, there are arms extending outwardly from the flange-like head of the stud. In this figure, the stud has a shank 20 and a flange-like head portion 21 as previously described and there is an axial hole passing through the shank and head. To more effectively distribute stresses and shock in the refractory tile and lessen the possibility of relative movement between the tile and the tube, there are a plurality of spaced extensions projecting laterally from the head. They may be formed of metal rods welded to the underside of the flange, or strips of flat bar stock. There are desirably three of these rods projecting tangentially from about the shank so that they are separated 120°. They are shown to be straight, but they may be curved from the plane of the flange to conform somewhat to the curvature of the tube about which tile is placed and prevent the ends of the extensions from reaching too close to the surface of the refractory.

Figure 6:
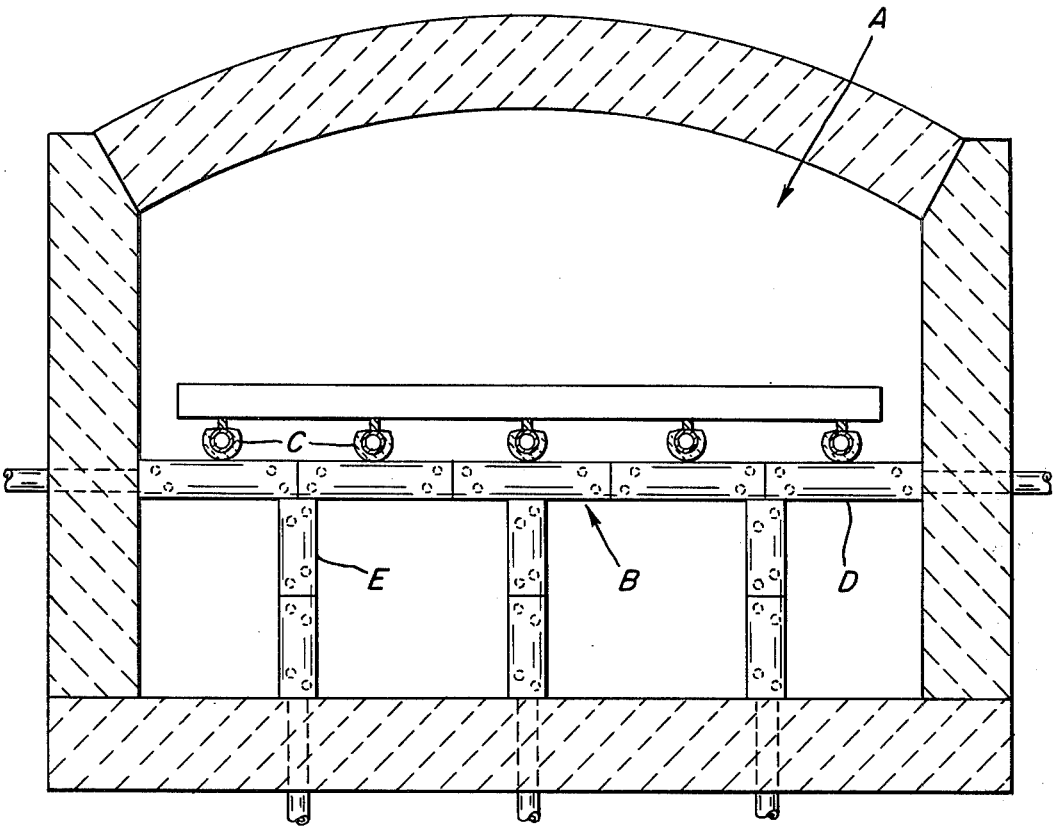
FIG. 6 is a transverse section through a heating furnace of the general type herein referred to showing a supporting frame with a workpiece resting on the skid rails.

FIG. 6 illustrates a typical embodiment of the invention wherein A designates one form of heating furnace which is in the form of a tunnel-like structure, this structure being shown in transverse section. The water-cooled work supporting frame is designated generally as B. It has longitudinally extending water-cooled skid rails C, as shown in section in FIG. 2, carried on water-cooled cross rails D in which the tile sections completely encircle the water-cooled tube and vertical water-cooled tubes E also completely surrounded by the complementary tile sections. A heavy solid slab is indicated as F and generally, as hereinbefore explained, these slabs move through the furnace in side-by-side contact so that the charging of a slab at the charging end may push one out at the discharge end, although in some cases the longitudinal supports may be walking beams that move the workpieces step by step through the furnace, as is well understood in the art.

As previously explained, the studs are of rigid metal with adequate wall thickness to enable the end of the stud to be effectively welded to the water-cooled tube and dampen vibration between the tube and refractory and confine the refractory between the head of the stud and the tube between two heat conducting surfaces.

I claim:

1. The combination with a metallurgical furnace having a water-cooled tubular work supporting structure thereon on which heavy slabs and other heavy metal objects are supported and progressively moved from a charging end to an exit, the supporting structure comprising upright and horizontal tubes through which said metal objects constituting several tons are intermittently moved under conditions creating violent impact and mechanical shock and vibration in the work supporting structure, the invention comprising a heat insulating covering of preformed refractory tiles wherein the tiles comprise a pair of complementary sections with the pairs placed end to end along the exterior of said tubes, each of the said tiles of a pair having a longitudinally extending groove extending along its inner surface which, when the pair is placed about a tube, snugly fits about and encloses the length of tube along which it extends, each tile of a pair having at least one radial opening therethrough near each end of the section, there being a fastening having a tubular shank open at each end in each radial opening and having its inner end welded to the water-cooled tube after placement of the tile section on the said tube, the tubular shank being of a length less than the depth of the radial opening in the tile, said shank having a laterally extending flange at its outer end with the body of the tile fitting around the tubular shank and confined between said flange and the water-cooled tube so that the tube, the fastening and the tile are fixed against relative motion when the water-cooled tube receives impact or shock, and a body of insulation over the flange and filling the radial opening.

2. The combination defined in claim 1 wherein the sleeve with its flange is molded in the body of the tile section and integrated therewith.

3. The combination defined in claim 1 wherein there is a second fastener near the opposite ends of each tile circumferentially and longitudinally offset from the first.

4. The combination defined in claim 2 wherein each of said flanges has spaced divergent extensions projecting outwardly from the periphery thereof into the body of the tile section to more effectively resist forces tending to rotate the tile section about the fastener and thereby more effectively resist breakage of the tile section from impact tending to rotate the water-cooled tube within the refractory sleeve sections.

* * * * *